US005425257A

United States Patent [19]

Kitsukawa et al.

[11] Patent Number: 5,425,257

[45] Date of Patent: Jun. 20, 1995

[54] METHOD AND APPARATUS FOR BENDING AN ELONGATE WORKPIECE

[75] Inventors: Motohiko Kitsukawa; Atsuo Suzuki, both of Kanagawa, Japan

[73] Assignee: Hashimoto Forming Industry Co., Ltd., Kanagawa, Japan

[21] Appl. No.: 156,864

[22] Filed: Nov. 19, 1993

Related U.S. Application Data

[63] Continuation of Ser. No. 17,346, Feb. 11, 1993, abandoned, which is a continuation of Ser. No. 837,535, Feb. 14, 1992, abandoned, which is a continuation of Ser. No. 545,479, Jun. 28, 1990, abandoned.

[30] Foreign Application Priority Data

Jun. 30, 1989 [JP] Japan ..... 1-166974

[51] Int. Cl.[6] ..... B21D 11/14

[52] U.S. Cl. ..... 72/17; 72/166; 72/168; 72/65

[58] Field of Search ..... 72/166, 169, 168, 384, 72/386, 64, 65, 17, 14

[56] References Cited

U.S. PATENT DOCUMENTS

| | | | |
|---|---|---|---|
| 4,061,005 | 12/1977 | Kawanami et al. | 72/166 |
| 4,080,815 | 3/1978 | Foster | 72/168 |
| 4,367,641 | 1/1983 | Mizutani | 72/166 |
| 4,391,116 | 7/1983 | Yogo | 72/166 |
| 4,624,121 | 11/1986 | Kitsukawa et al. | 72/65 |

FOREIGN PATENT DOCUMENTS

| | | |
|---|---|---|
| 0157537 | 10/1985 | European Pat. Off. . |
| 0239364 | 9/1987 | European Pat. Off. . |

*Primary Examiner*—Daniel C. Crane
*Attorney, Agent, or Firm*—Weiser & Associates

[57] ABSTRACT

A method and an apparatus for bending manufacturing of a long workpiece capable of manufacturing different sections of the workpiece in different bending radiuss, while preventing a buckling deformation in manufacturing small bending radius sections and a lowering of a productivity. A speed of sending out the workpiece is controlled to be lower for sections requiring larger bending per unit length, so as to prevent the buckling deformation, and to be higher for sections requiring smaller bending per unit length, so as to prevent the lowering of the productivity.

6 Claims, 6 Drawing Sheets

FIG.7

| | | $L_1$ | | $L_2$ | | $L_3$ | | | $L_4$ | | | $L_5$ |
|---|---|---|---|---|---|---|---|---|---|---|---|---|
| SEGMENT NO. | 0.1···10 | 11···20 | 21···30 | 31···40 | 41···50 | 51···60 | 61···70 | 71···80 | 81···90 | 91···100 | 101···110 | 111···120 |
| BENDING INDEX IN X | | 0···2 | | 3···1 | | 1···1 | | 1···0.5 | 0.5···1 | | | 4···0 |
| BENDING INDEX IN Y | | 1···1 | | 1···5 | | 1···1 | | 1···9 | 9···9 | | | 1···0 |
| BENDING INDEX IN $\theta$ | | 0···2 | | 2···1 | | 1···2 | | 0···0 | 0···0 | | | 0···0 |
| TOTAL BENDING INDEX | | 1···5 | | 6···7 | | 3···4 | | 2···9.5 | 9.5···10 | | | 5···0 |
| SPEED OF SENDING OUT | $V_1$ | $V_1$ | | $V_2$ | | $V_1$ | | $V_3$ | $V_3$ | | | $V_4$ |

METHOD AND APPARATUS FOR BENDING AN ELONGATE WORKPIECE

RELATED CASES

This patent application is a continuation of U.S. patent application Ser. No. 08/017,346, filed Feb. 11, 1993, and since abandoned, which is itself a continuation of U.S. patent application Ser. No. 07/837,535, filed Feb. 14, 1992, and since abandoned, which is itself a continuation of U.S. patent application Ser. No. 07/545,479, filed Jun. 28, 1990, and since abandoned.

BACKGROUND OF THE INVENTION

1. Field of the Invention

The present invention relates to a bending manufacturing of a long workpiece in which the workpiece is bent while being moved along its length direction.

2. Description of the Background Art

An example of a conventional apparatus for bending manufacturing of a long workpiece can be found in U.S. Pat. No. 4,367,641.

A long workpiece to be manufactured In such an apparatus can be utilized as a seat belt guide for a passive seat belt of a car, for instance. The passive seat belt is a type of seat belt which automatically hold a passenger in a restraint posture when the sitter sits down and closes a door. This is achieved by fixing one end of the seat belt to a console box side of the seat, while attaching another end to a cable side which is slidable in forward and backward direction along the seat belt guide such as that shown in FIG. 1 which is provided in a vicinity of a window sash. The seat belt guide of FIG. 1 has five sections L1, L2, L3, L4, and L5 of different curvatures R1, R2, R3, R4, and R5, respectively, along its length direction, in accordance with a shape of the window sash. Also, as shown in FIG. 2, this seat belt guide has a curvature R6 on its side face, in accordance with a car body shape.

This seat belt guide is manufactured from a workpiece W shown in FIG. 3 which is made of aluminum alloy and which is to be manufactured by extrusion into a form of U-shaped bar having a groove 1 along its length direction along which the cable side of the seat belt is to slide. This workpiece W of FIG. 2 is then bending manufactured in X and Y directions to make the seat belt guide in a form shown in FIG. 1 and FIG. 2. In addition, for some car body shapes, it is necessary to give a twist in a direction $\theta$.

An apparatus for performing such bending manufacturing of a long workpiece generally comprises a carrier device equipped with carrier rollers for sending out the workpiece along its length direction; a supporting device located in front of the carrier device in a direction in which the workpiece is sent out which is equipped with supporting rollers corresponding to points of support in bending operation, and a bending device located further in front of the supporting device which is equipped with bending rollers to function as points of pressing in bending operation. The bending device is capable of swaying the bending rollers about vertical and horizontal axes, so that a three-dimensional bending manufacturing can be applied to a workpiece.

In such a conventional apparatus for bending manufacturing, a speed of sending out the workpiece is constant throughout an entire process of bending manufacturing. This fact causes no problem for manufacturing of large bending radius sections such as L1 and L3 of the workpiece of FIG. 1 which have relatively large bending radii R1 and R3, respectively. However, in manufacturing of small bending radius sections such as L2 and L4 of the workpiece of FIG. 1 which have relatively small bending radiuss R2 and R4, respectively, sending out of the workpiece at the same speed as manufacturing of small bending radius sections could give rise to a potential danger of a buckling deformation of the workpiece. If the speed of sending out the workpiece is lowered to suit the manufacturing of small bending radius sections, the sending speed is unnecessarily slow for the manufacturing of the large bending radius sections, which causes lowering of a productivity.

SUMMARY OF THE INVENTION

It is therefore an object of the present invention to provide a method and an apparatus for bending manufacturing of a long workpiece capable of manufacturing different sections of the workpiece in different bending radii, while preventing a buckling deformation in manufacturing small bending radius sections and a lowering of a productivity.

According to one aspect of the present invention there is provided a method of bending manufacturing of a long workpiece, comprising the steps of: sending out the workpiece along a direction of a length of the workpiece into a bending position; bending each section of the workpiece by desired amount of bending, as each section reaches the bending position sequentially, due to said sending; and controlling a speed of sending out the workpiece such that the speed is made lower for a section located at the bending position which requires larger amount of bending per unit length than the speed for a section which requires smaller amount of bending per unit length, and that the speed is made higher for a section located at the bending position which requires smaller amount of bending per unit length than the speed for a section which requires larger amount of bending per unit length.

According to another aspect of the present invention there is provided an apparatus for bending manufacturing of a long workpiece, comprising: means for sending out the workpiece along a direction of a length of the workpiece into a bending position; means for bending each section of the workpiece by desired amount of bending, as each section reaches the bending position sequentially, due to the sending by the sending means; and means for controlling a speed of sending out the workpiece by the sending means such that the speed is made lower for a section located at the bending position which requires larger amount of bending per unit length than the speed for a section which requires smaller amount of bending per unit length, and that the speed is made higher for a section located at the bending position which requires smaller amount of bending per unit length than the speed for a section which requires larger amount of bending per unit length.

Other features and advantages of the present invention will become apparent from the following description taken in conjunction with the accompanying drawings.

BRIEF DESCRIPTION OF THE DRAWINGS

FIG. 7 is a table specifying amounts of bending and a speed of sending out the workpiece for each segment of the workpiece, according to which the apparatus of FIG. 4 operates.

DETAILED DESCRIPTION OF THE PREFERRED EMBODIMENTS

Figure 4:
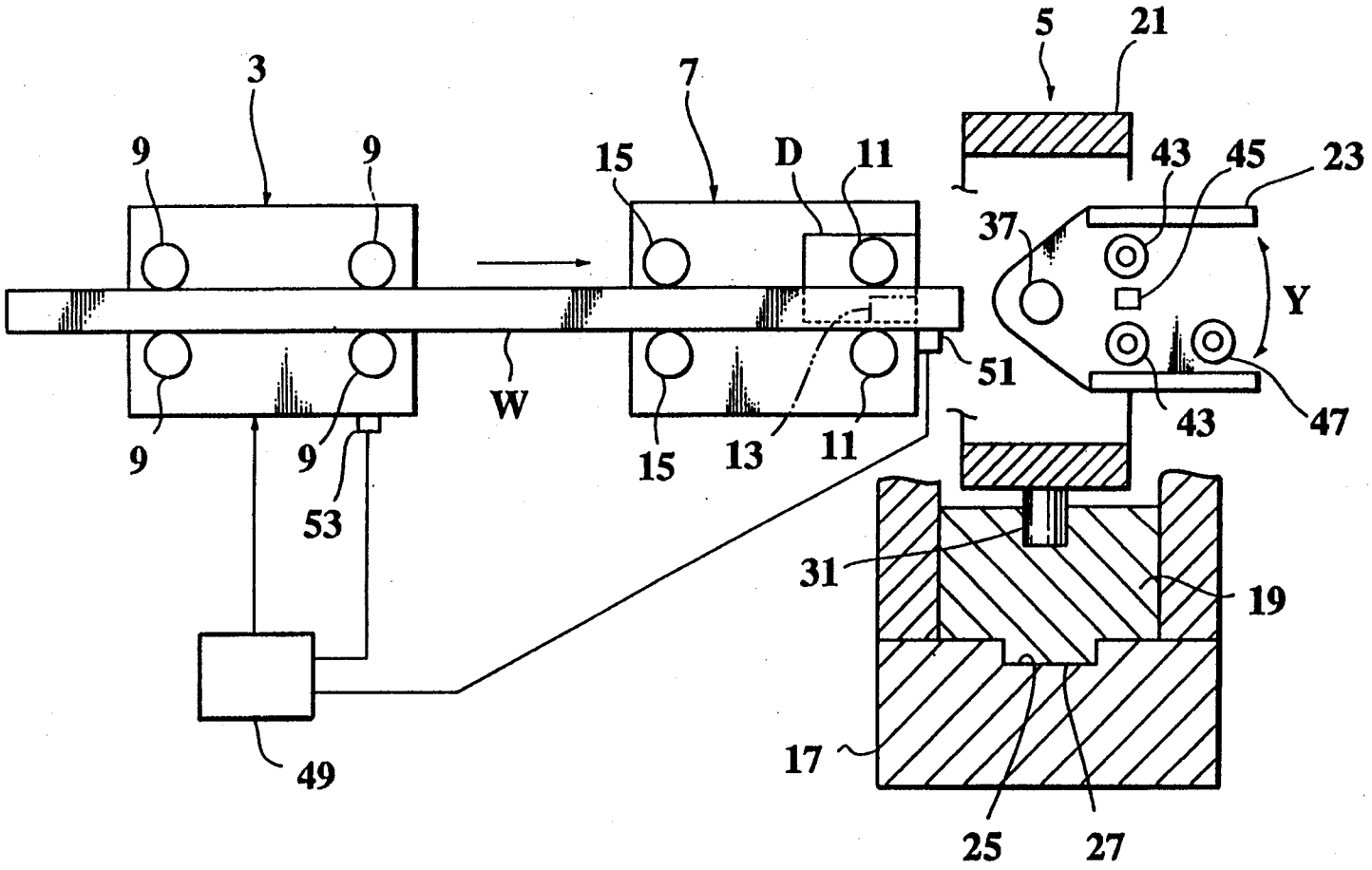
FIG. 4 is a side view of one embodiment of an apparatus for bending manufacturing according to the present invention.
Figure 5:
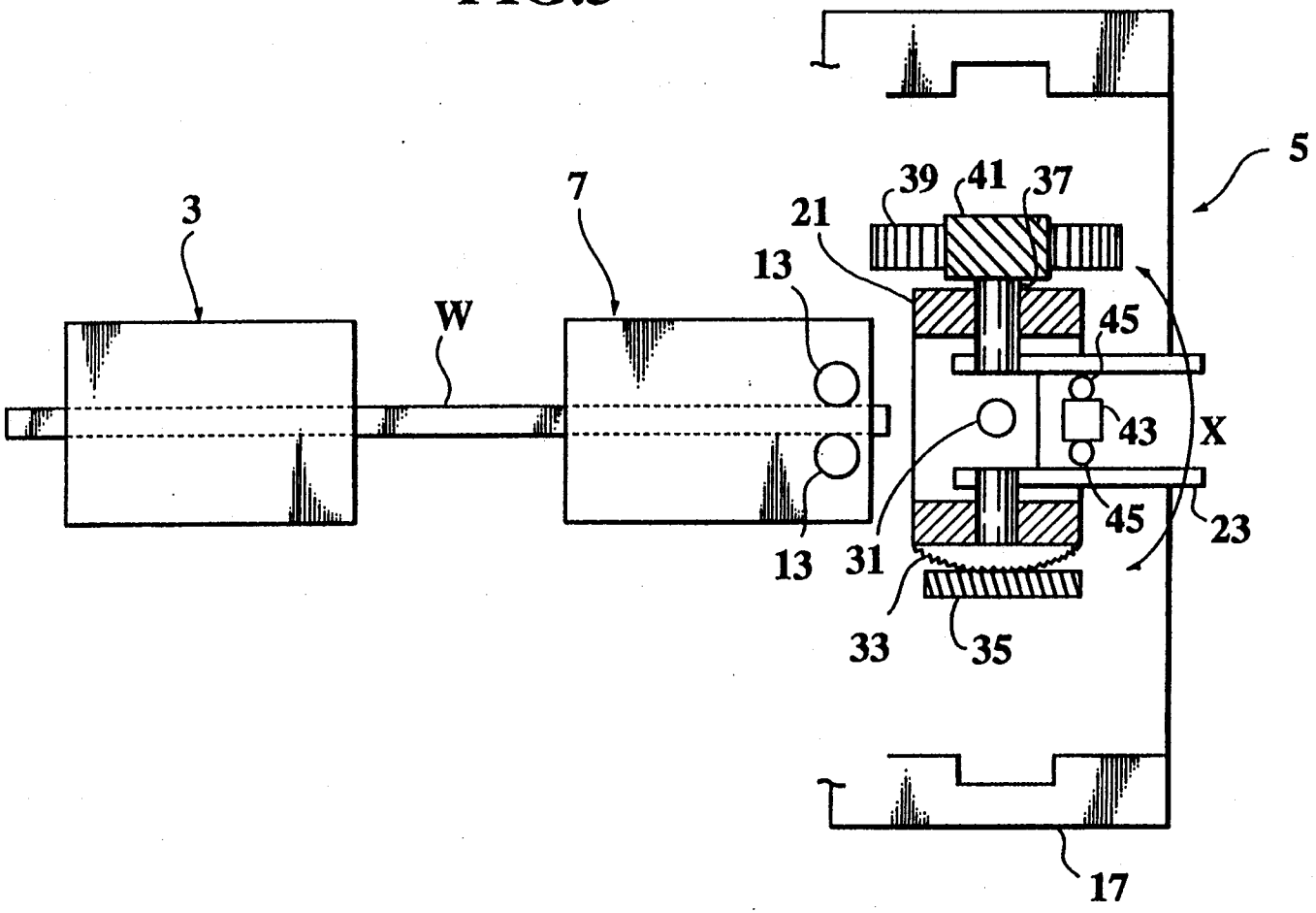
FIG. 5 is a top view of the apparatus for bending manufacturing of FIG. 1.
Figure 6:
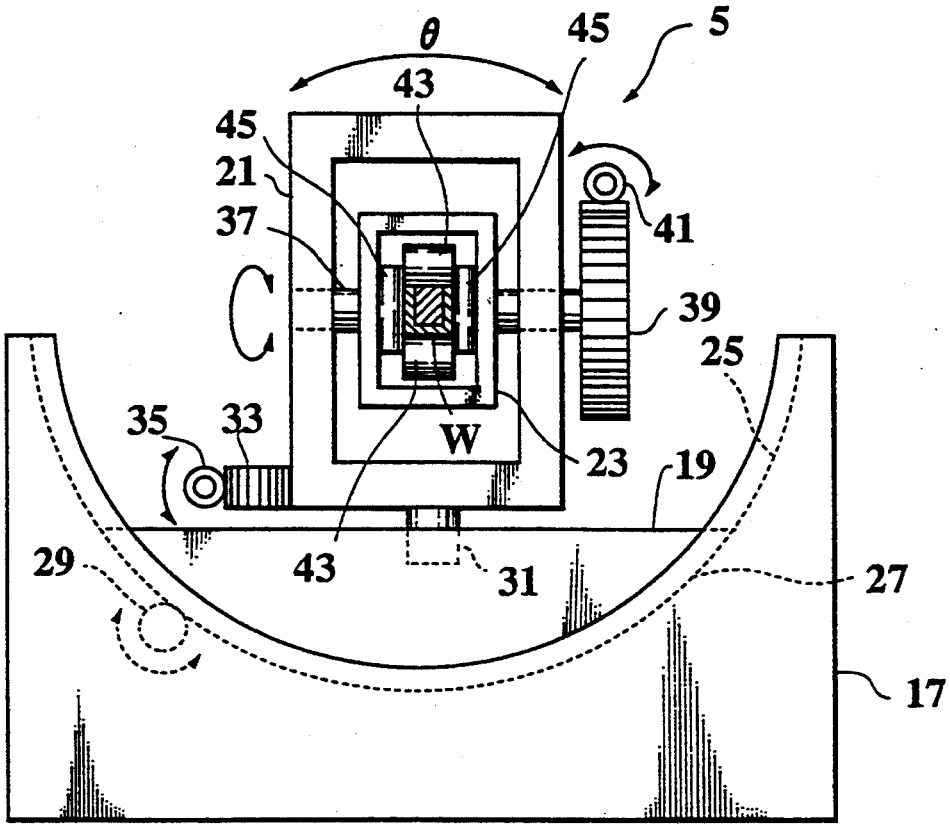
FIG. 6 is a front view of a bending device of the apparatus for bending manufacturing of FIG. 1.

Referring now to FIG. 4 to FIG. 6, there is shown one embodiment of an apparatus for bending manufacturing according to the present invention.

Figure 1:
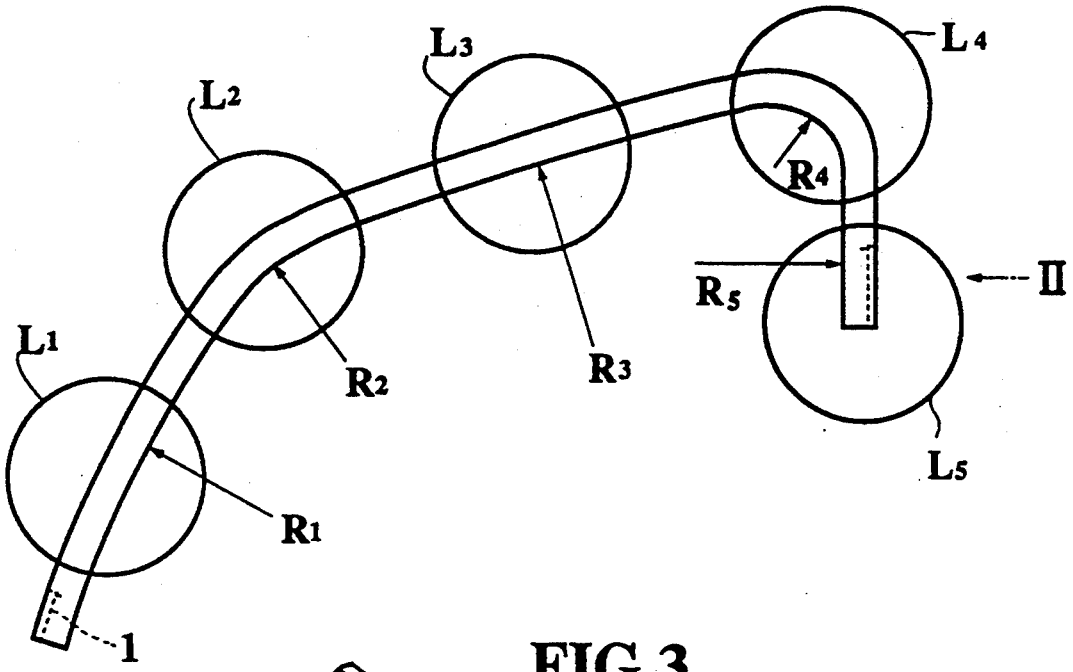
FIG.1 PRIOR ART
FIG. 1 is a front view of a seat belt guide to be manufactured from a workpiece by an apparatus for bending manufacturing.
Figure 3:
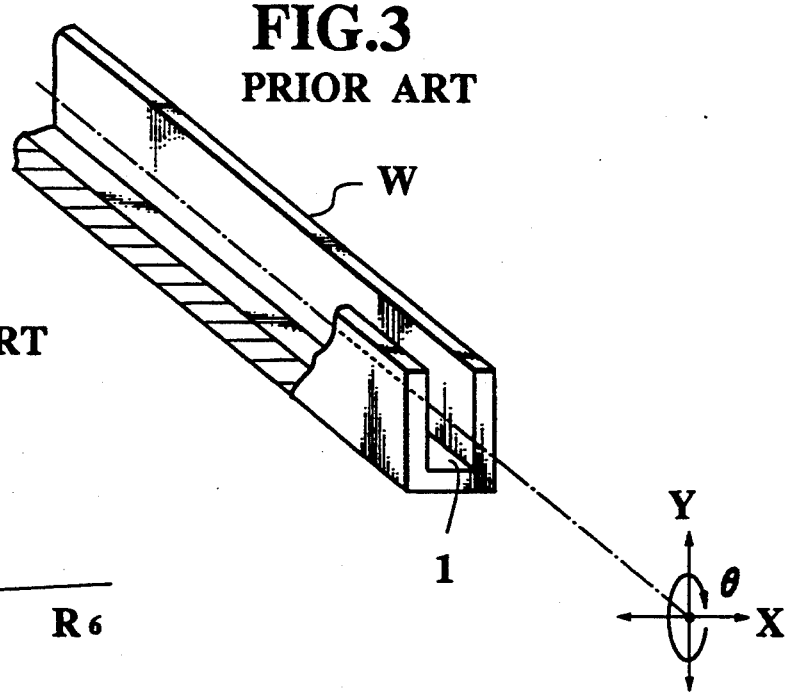
FIG.3 PRIOR ART
FIG. 3 is a partially cutaway perspective view of a workpiece to be manufactured into the seat belt guide of FIG. 1.
Figure 2:
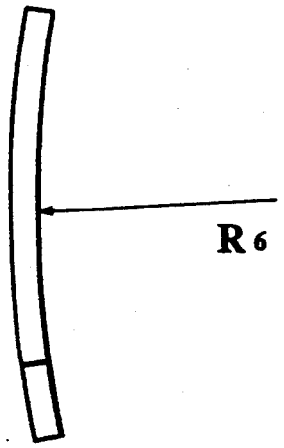
FIG.2 PRIOR ART
FIG. 2 is a side view seat belt guide of FIG. 1 seen from the II direction indicated in FIG. 1.

In this embodiment, the apparatus is adapted to manufacture a workpiece W of FIG. 3 to be manufactured into a seat belt guide for a passive seat belt of FIG. 1 and FIG. 2 which is made of aluminum alloy and which is to be manufactured by extrusion into a form of U-shaped bar having a groove 1 along its length direction. This workpiece is set to the apparatus with the groove 1 facing upwards.

The apparatus generally comprises a carrier device 3 for sending out the workpiece W, a bending device 5 located in front of the carrier device 3 for applying bending force onto the workpiece W, and a supporting device 7 located between the carrier device 3 and the bending device 5 for supporting the workpiece W.

The carrier device 3 has two pairs of carrier rollers 9 which are rotated by a controllable motor (not shown). Each pair of carrier rollers 9 pinches the workpiece W in the vertical direction, and these pairs of carrier rollers 9 are provided along a direction of a length of the workpiece W, such that the workpiece W is sent out toward the supporting device 7.

The supporting device 7 has a pair of vertical supporting rollers 11 for supporting the workpiece W in the vertical direction, and a pair of horizontal supporting rollers 13 for supporting the workpiece W in the horizontal direction. These vertical and horizontal supporting rollers 11 and 13 are provided near an end of the supporting device 7 closer to the bending device 5, so that they can also function as points of support in bending operation. The supporting device 7 also has a pair of rear rollers 15 for supporting the workpiece W provide near another end of the supporting device 7 closer to the carrier device 3. Along with the upper one of the vertical supporting rollers 11, there is also provided a supporting die D which is to be inserted into the groove 1 of the workpiece W during the bending, in order to prevent deformation of the Workpiece W. This supporting die D is made of steel which had been quench hardened in order to improve its anti-abrasion property.

The bending device 5 comprises a device body 17, a base 19 located on the device body 17, an outer frame 21 placed over the base 19, and an inner frame 23 supported by the outer frame 21.

As can be seen in a front view of the bending device 5 shown in FIG. 6, the device body 17 has a concave upper surface of a semi-circular transverse cross section with a center at a position of the workpiece W, and a semi-circular U-shaped groove 25 is provided along this concave upper surface.

On the other hand, the base 19 has a convex lower surface in correspondence to the concave upper surface of the device body 17, and a gear rail 27 which fits in and rolls along the U-shaped groove 25 of the device body 17. The gear fall 27 is engaged with a driving gear 29 attached to the device body 17. Thus, when the driving gear 29 is driven by a power source (not shown), the base 19 can be swayed with respect to the device body 17 in a direction $\theta$ of FIG. 6, as the gear rail 27 rolls along the U-shaped groove 25. Since the center of this swaying coincides with a central axis of the workpiece W, a twisting can be applied to the workpiece W by means of this swaying of the base 19.

The outer frame 21 is in a form of a hollow box, and can be rotated around a vertical axis 31 with respect to the base 19. On a lower side of this outer frame 21, there is provided a worm wheel 33 which is engaged with a worm gear 35 connected to a power source (not shown). Thus, when the worm gear 35 is driven, the outer frame 21 rotates around the vertical axis 31 in an X direction in FIG. 5, by means of which the workpiece W can be bent in the X direction.

The inner frame 23 is also in a form of a hollow box, and can be rotated around a horizontal axis 37 with respect to the outer frame 21. One end of the horizontal axis 37 is extended outside of the outer frame 21 and attached to a worm wheel 39 which is engaged with a worm gear 41 connected to a power source (not shown). Thus, when the worm gear 41 is driven, the inner frame 23 rotates around the horizontal axis 37 in a Y direction in FIG. 4, by means of which the workpiece W can be bent in the Y direction.

The inner frame 23 is equipped with a pair of vertical bending rollers 43 which pinches the workpiece W in the vertical direction and function as points of pressing in the bending operation in the vertical direction (Y direction); and a pair of horizontal bending rollers 45 which pinches the workpiece W in the horizontal direction and function as points of pressing in the bending operation in the horizontal direction (X direction). The inner frame 23 is further equipped with an auxiliary roller 47 for rotatably contacting with a lower side of the workpiece W.

Now, in this embodiment, the controllable motor (not shown) for driving the carrier rollers 9 is controlled by a control device 49 equipped with a control circuit in a form of a micro-computer, such that a speed of rotation of the carrier rollers 9 can be varied under this control by the control device 49.

In addition, a first sensor 51 for detecting a front end of the workpiece W being sent out from the carrier device 3 is attached to a front end of the supporting device 7 which is closer to the bending device 5; and a second sensor 53 for detecting an amount of rotation of the carrier rollers 9 after the front end of the workpiece W is detected by the first sensor 51 is attached to the carrier device 3. The sensor outputs of these first and second sensors 51 and 53 are supplied to the control device 49, such that the control device 49 can control the speed of rotation of the carrier rollers 9 in accordance with the amount of rotation of the carrier rollers 9 detected by the second sensor 53 after the front end of the workpiece W is detected by the first sensor 51.

The amount of rotation of the carrier rollers 9 is proportional to a length of the workpiece W being sent out, so that this amount can indicate which section of the workpiece W is located at a bending position in the bending device 5. Accordingly, the speed of the rotation of the carrier rollers 9 is determined in accordance with an amount of bending required by a section currently being located at the bending position.

The workpiece W is to be manufactured into a seat belt guide of a form shown in FIG. 1 and FIG. 2, which has five sections L1, L2, L3, L4, and L5 of different bending radii R1, R2, R3, R4, and R5, respectively, along its length direction, and a bending radius R6 on its side face. In this embodiment, the sections L1, L2, L3, L4, and L5 are manufactured in this order, so that these sections L1, L2, L3, L4, and L5 are sequentially thrusted into the bending position inside the bending device 5 by the carrier device 3.

The speed of sending out the workpiece W is controlled according to a table of FIG. 7. Here, an entire workpiece of 1200 mm is divided into 12 segments of 10 mm each, and the speed of sending the workpiece W is specified for each segment in terms of four different speeds V1, V2, V3, and V4, where $V4>V1>V2>V3$. Aiso, in FIG. 7, amounts of bending in the X, Y, and $\theta$ directions, as well as a sum total of these amounts are specified for the segments corresponding to the sections L1, L2, L3, L4, and L5 of the seat belt guide of FIG. 1, in terms of a bending index taking a value within a range of 0 to 10.

Next, the bending manufacturing of this workpiece W by this apparatus will be described in an actual order of operations.

First, the workpiece W is sent out from the carrier device 3 toward the supporting device 7 at a relatively fast speed of V1.

Then, a front end of the workpiece W is detected by the first sensor 51 attached to the supporting device 7, and in response to this detection by the first sensor 51, the control device 49 determines an amount of rotation of the carrier rollers 9 by using the second sensor 58, so as to control the speed of rotation of the carrier rollers 9 in accordance with this amount of rotation.

When the section L1 is at a bending position in the bending device 5, the speed of the rotation is unchanged from relatively high speed of V1, because only relatively small amounts of bending up to 5 are required in this section L1.

When the section L2 is at a bending position in the bending device 5, the speed of the rotation is changed to a speed of V2 relatively lower than the speed V1, because relatively larger amounts of bending of 6 to 7 are required in this section L2.

When the section L3 is at a bending position in the bending device 5, the speed of the rotation is changed back to the relatively high speed of V1, because only relatively small amounts of bending of 3 to 4 are required in this section L3.

When the section L4 is at a bending position in the bending device 5, the speed of the rotation is changed to a rather low speed of V3 lower than the speed V2, because rather larger amounts of bending of 9.5 to 10 are required in this section L4.

Finally, when the section L5 is at a bending position in the bending device 5, the speed of the rotation is changed to a rather high speed of V4 higher than the speed V1, because rather small amounts of bending of 5 to 0 are required in this section L5.

Figure 8A:
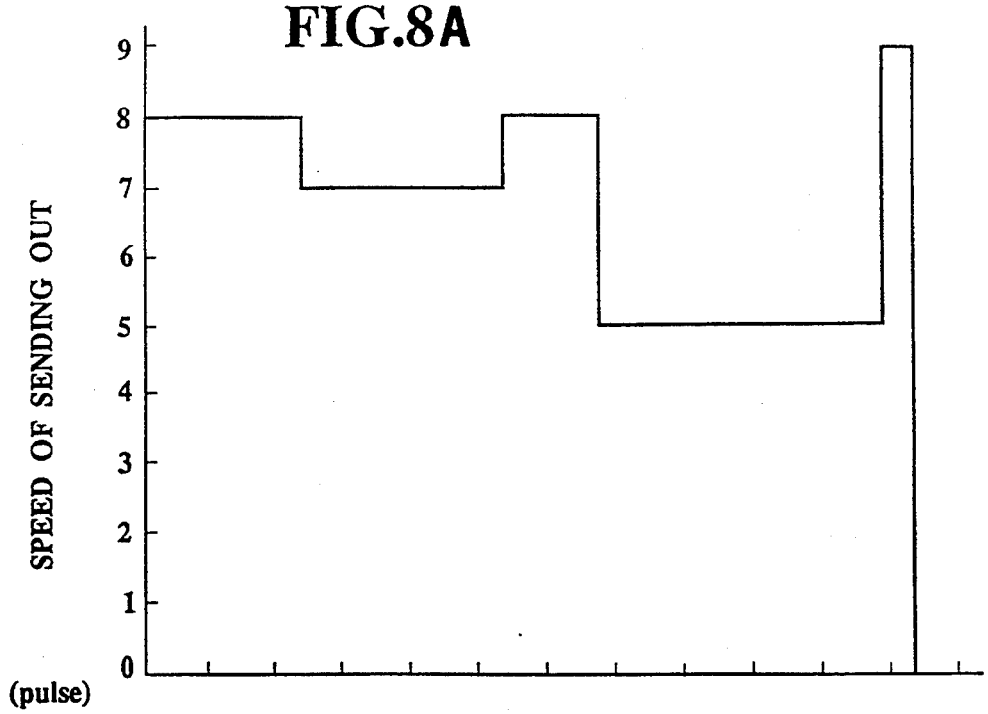
FIG. 8 is a diagram of a speed of sending out the workpiece and an amount of rotational motion at a bending device of the apparatus of FIG. 4 In the Y direction for each position on the workpiece, which shows the operation of the apparatus of FIG. 4 operated according to the table of FIG. 7.
Figure 8B:
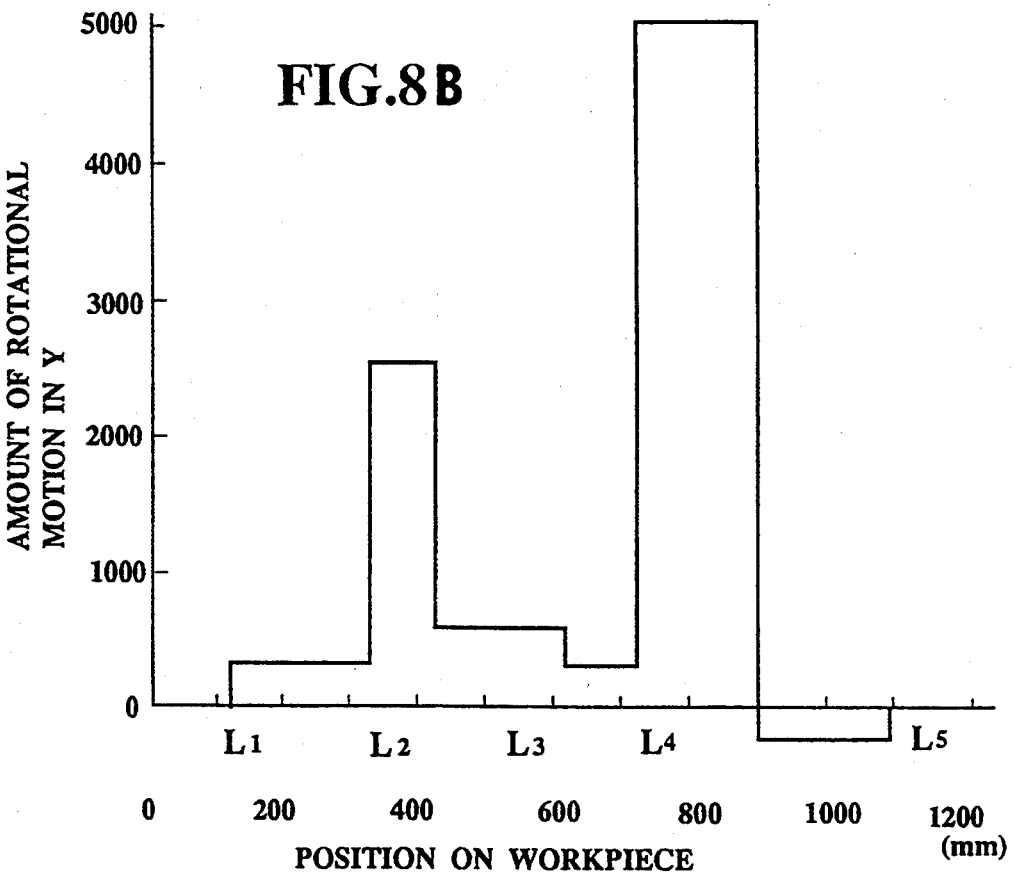

FIG. 8 shows a relationships between the speed of sending out the workpiece W and an amount of rotational motion at the bending device 5 in the Y direction for each position on the workpiece W. As can be seen in FIG. 8, the speed of sending is controlled to be lower for segments requiring larger amount of bending, and to be higher for segments requiring smaller amount of bending. It is to be noted that the speed of sending is lowered not only for the segments requiring large amount of bending themselves, such as those corresponding to the sections L2 and L4, but also for other segments nearby these segments requiring large amount of bending. It is also to be noted that although a naive argument presented above can explain the relationship of FIG. 8 qualitatively, in reality, contributions from the bending in the X and $\theta$ directions also have to be taken into account.

As described, according to this embodiment, It is possible to perform the bending manufacturing of a long workpiece with different sections of the workpiece manufactured in different bending radiuss, while preventing a buckling deformation in manufacturing small bending radius sections by lowering the speed of rotation of the carrier rollers, and at the same time preventing a lowering of a productivity by speeding up the speed of rotation of the carrier rollers in manufacturing large bending radius sections.

It is to be noted that in order to further improve the productivity, the control of the speed of sending the workpiece may be limited only to particularly large bending sections, instead of very thorough controlling as described in the above embodiment, within a limit of requirement for the quality of the product.

Besides this, many modifications and variations of the above embodiments may be made without departing from the novel and advantageous features of the present invention. Accordingly, all such modifications and variations are intended to be included within the scope of the appended claims.

What is claimed is:

1. A method of bending an elongate workpiece, comprising the steps of:

feeding the workpiece at a speed and in a first direction defined longitudinally along the workpiece into a device for supporting the workpiece so that the workpiece is movable only in the first direction;

bending successively fed sections of the workpiece by a desired amount in a bending device associated with the supporting device, said bending including;

holding the workpiece for movement only in the first direction by holding members provided in the bending device so that the workpiece is not freely rotatable relative to axes defined in second and third directions which are mutually orthogonal to the first direction in the bending device; and driving the bending device in both the second and third directions and rotating the bending device about an axis defined in the first direction according to the desired amount of bending so that a bending force which corresponds to the desired amount of bending is applied to the workpiece by the bending device; and controlling the speed of the workpiece so that the speed is made lower for a section of the workpiece located in the bending device which requires a larger amount of bending per unit length than the speed for a section of the workpiece which requires a smaller amount of bending per unit length, while the speed is made higher for a section of the workpiece located in the bending device which requires a smaller amount of bending per unit length than the speed for a section of the workpiece which requires a larger amount of bending per unit length, and so that the speed is decreased before bending the section of the workpiece which requires a larger amount of bending per unit length when changing from a section of the workpiece with a smaller amount of bending per unit length to a section of the workpiece with a larger amount of bending per unit length, while the speed is increased after bending the section of the workpiece which requires a larger amount of bending per unit length when changing from a section of the workpiece with a larger amount of bending per unit length to a section of the workpiece with a smaller amount of bending per unit length.

2. The method of claim 1, wherein said controlling of the speed comprises the steps of:

detecting an end of a section of the workpiece;

determining an amount by which the workpiece has been fed since detecting the end of a prior section of the workpiece;

identifying a section of the workpiece currently located in the bending device responsive to the determined amount of feeding; and controlling the speed in accordance with the amount of bending required for the identified section.

3. The method of claim 1 wherein the workpiece is free to move only in the first direction.

4. An apparatus for bending an elongate workpiece, comprising:

means for feeding the workpiece at a speed and in a first direction defined longitudinally along the workpiece into a device for supporting the workpiece so that the workpiece is movable only in the first direction;

means for bending successively fed sections of the workpiece by a desired amount in a bending device associated with the supporting device, said bending device including;

holding members for holding the workpiece for movement only in the first direction in the bending device so that the workpiece is not freely rotatable relative to axes defined in second and third directions which are mutually orthogonal to the first direction in the bending device; and means for driving the bending device in both the second and third directions and for rotating the bending device about an axis defined in the first direction according to the desired amount of bending so that a bending force which corresponds to the desired amount of bending is applied to the workpiece by the bending device; and means for controlling the speed of the workpiece so that the speed is made lower for a section of the workpiece located in the bending device which requires a larger amount of bending per unit length than the speed for a section of the workpiece which requires a smaller amount of bending per unit length, while the speed is made higher for a section of the workpiece located in the bending device which requires a smaller amount of bending per unit length than the speed for a section of the workpiece which requires a larger amount of bending per unit length, and so that the speed is decreased before bending the section of the workpiece which requires a larger amount of bending per unit length when changing from a section of the workpiece with a smaller amount of bending per unit length to a section of the workpiece with a larger amount of bending per unit length, while the speed is increased after bending the section of the workpiece which requires a larger amount of bending per unit length when changing from a section of the workpiece with a larger amount of bending per unit length to a section of the workpiece with a smaller amount of bending per unit length.

5. The apparatus of claim 4, wherein said controlling means comprises:

means for detecting an end of a section of the workpiece;

means for determining an amount by which the workpiece has been fed since detecting the end of a prior section of the workpiece;

means for identifying a section of the workpiece currently located in the bending device responsive to the determined amount of feeding; and means for controlling the speed in accordance with the amount of bending required for the identified section.

6. The apparatus of claim 4 wherein the workpiece is free to move only in the first direction.

* * * * *